US011091296B2

(12) United States Patent
Petkovsek et al.

(10) Patent No.: US 11,091,296 B2
(45) Date of Patent: Aug. 17, 2021

(54) RECLOSEABLE ZIPPER CLOSURE ARRANGEMENT, RECLOSEABLE POUCHES, AND METHODS

(71) Applicant: Reynolds Presto Products Inc., Lake Forest, IL (US)

(72) Inventors: Gregory L. Petkovsek, Waupaca, WI (US); Todd Robbins, Appleton, WI (US)

(73) Assignee: Reynolds Presto Products Inc., Lake Forest, IL (US)

( * ) Notice: Subject to any disclaimer, the term of this patent is extended or adjusted under 35 U.S.C. 154(b) by 0 days.

(21) Appl. No.: 16/487,515

(22) PCT Filed: Feb. 23, 2018

(86) PCT No.: PCT/US2018/019480
§ 371 (c)(1),
(2) Date: Aug. 21, 2019

(87) PCT Pub. No.: WO2018/156931
PCT Pub. Date: Aug. 30, 2018

(65) Prior Publication Data

US 2020/0055637 A1 Feb. 20, 2020

Related U.S. Application Data

(60) Provisional application No. 62/463,000, filed on Feb. 24, 2017.

(51) Int. Cl.
*B65D 33/00* (2006.01)
*B65D 33/25* (2006.01)
(Continued)

(52) U.S. Cl.
CPC ..... *B65D 33/255* (2013.01); *B31B 70/8131* (2017.08); *B65D 33/2558* (2013.01); *B65D 33/2566* (2013.01); *B31B 2160/10* (2017.08)

(58) Field of Classification Search
CPC ..... B65D 33/255; B65D 33/2558; B65D 33/2566; B31B 70/8131; B31B 2160/10
(Continued)

(56) References Cited

U.S. PATENT DOCUMENTS 5,363,540 A * 11/1994 Dais ..... B65D 33/2541 24/399
5,509,734 A * 4/1996 Ausnit ..... B65D 33/255 383/63

(Continued)

FOREIGN PATENT DOCUMENTS

WO 96/28063 A1 9/1996
WO 2013/119727 A1 8/2013

OTHER PUBLICATIONS

International Search Report and Written Opinion from PCT/US2018/019480, dated May 4, 2018.

*Primary Examiner* — Peter N Helvey
(74) *Attorney, Agent, or Firm* — Merchant & Gould P.C.

(57) ABSTRACT

A recloseable zipper closure arrangement useable in a recloseable plastic bag includes a first elongate base strip having a front side and an opposite back side; and a first continuous profile member on the front side of the first elongate base strip; the first continuous profile member having a clicking sensory indicator having a central rib with a continuous peak; and a second continuous profile member on the front side of the first elongate base strip and spaced from the first profile member; the second continuous profile member may have optionally a clicking sensory indicator having a central rib with a continuous peak.

10 Claims, 8 Drawing Sheets

(51) Int. Cl.
*B31B 70/81* (2017.01)
*B31B 160/10* (2017.01)

(58) Field of Classification Search
USPC ..... 383/63
See application file for complete search history.

(56) References Cited

U.S. PATENT DOCUMENTS 5,647,100 A * 7/1997 Porchia ..... B65D 33/2508 24/30.5 R
7,857,515 B2 * 12/2010 Dais ..... B65D 33/25 383/59
7,946,766 B2 * 5/2011 Dais ..... B65D 81/2038 383/59
8,197,139 B2 * 6/2012 Turvey ..... B65D 33/1691 383/103
8,215,839 B2 * 7/2012 Borchardt ..... B65D 33/255 383/63
2005/0271307 A1 * 12/2005 Pawloski ..... B65D 33/2566 383/63
2005/0271308 A1 * 12/2005 Pawloski ..... B65D 33/255 383/63
2006/0008185 A1 * 1/2006 Borchardt ..... B65D 33/255 383/63
2006/0168776 A1 8/2006 Dais et al.
2012/0106874 A1 * 5/2012 Pawloski ..... B65D 33/255 383/63
2012/0106875 A1 * 5/2012 Pawloski ..... B65D 33/255 383/64
2012/0213454 A1 * 8/2012 Price ..... B65D 75/5855 383/63
2012/0301056 A1 * 11/2012 Anzini ..... B65D 33/255 383/61.2
2014/0270587 A1 * 9/2014 Schreiter ..... B65D 33/255 383/64
2015/0049962 A1 * 2/2015 Bois ..... B65D 33/2566 383/63
2015/0367995 A1 * 12/2015 Turvey ..... B65D 33/255 383/64

* cited by examiner

RECLOSEABLE ZIPPER CLOSURE ARRANGEMENT, RECLOSEABLE POUCHES, AND METHODS

This application is a National Stage Application of PCT/US2018/019480, filed Feb. 23, 2018, and claims priority to U.S. Provisional Patent Application No. 62/463,000, filed Feb. 24, 2017, the disclosures of which are hereby incorporated by reference herein in their entirety. To the extent appropriate, a claim of priority is made to each of the above disclosed applications.

TECHNICAL FIELD

This disclosure relates to recloseable pouches, such as recloseable thermoplastic bags that are closed with recloseable zipper arrangements. The disclosure particularly concerns such arrangements in which the recloseable zipper arrangements are configured for a clicking sensory (audible and/or tactile) indication of closure seal or lock.

BACKGROUND

In prior art press-to-close recloseable plastic zippers, misalignment between the male and female zipper profiles can occur, in which the result is incomplete closure. This problem can occur either through consumer misuse, or during construction of the zipper closure, or when the zipper closure is converted into a package. When this improper closure happens, product contents are not properly contained or kept fresh, and consumer satisfaction is sacrificed.

Many consumers find sensory assurance helpful in indicating that the reclosable zipper is completely closed. In the prior art, one type of sensory assurance is the use of a slider member on the zipper closure. The consumer will be able to observe that the slider member has been moved from one end of the zipper to the other end and be reasonably assured that the closure is properly closed. With prior art press-to-close zipper closures, there is very little visual indication to the consumer to inform the consumer whether the zipper closure is properly and completely closed.

In prior art hook-and-loop or hook-and-hook closures, the consumer receives some sensory feedback that the closure is properly closed. Some of the problems with those types of closures, however, are that they are inefficient to manufacture, allow passage for gas transfer from the outside of the package to the inside, and typically have low lock strength. While many consumers consider those types of closures to be easy to use, they are not perceived by consumers to provide an acceptable level of freshness for most food products.

Improvements are desirable.

SUMMARY

A recloseable zipper closure arrangement is provided that improves the prior art. The recloseable zipper closure arrangement is easy to align, easy to close, and has sensory feedback that keeps products fresh when closed.

A recloseable zipper closure arrangement useable in a recloseable plastic bag is provided. The zipper closure arrangement includes a first elongate base strip having a front side and an opposite back side; and a first continuous profile member on the front side of the first elongate base strip; the first continuous profile member comprising a clicking sensory indicator having a central rib with a continuous peak; and a second continuous profile member on the front side of the first elongate base strip and spaced from the first profile member; the second continuous profile member comprising a clicking sensory indicator having a central rib with a continuous peak.

The closure arrangement may further include a third continuous profile member on the front side of the first elongate base strip and spaced from the second profile member; the second profile member being between the first profile member and the third profile member.

The closure arrangement may further include a fourth continuous profile member on the front side of the first elongate base strip and spaced from the third profile member; the third profile member being between the second profile member and the fourth profile member; and a fifth continuous profile member on the front side of the first elongate base strip and spaced from the fourth profile member; the fourth profile member being between the third profile member and the fifth profile member.

In some arrangements, at least one of the third, fourth, and fifth continuous profile members includes a clicking sensory indicator having a central rib with a continuous peak.

In some arrangements, each of the third, fourth, and fifth continuous profile members includes a clicking sensory indicator having a central rib with a continuous peak.

In some arrangements, the first continuous profile member includes a side arm arrangement and alternating first and second sections along a zipper direction, wherein: in each one of the plurality of first sections, the side arm arrangement comprises at least one side arm projecting away from the central rib and defining a side hook receiver on the central rib between each side arm and the first elongate base strip; and in each one of the plurality of second sections, there is an absence of a side arm projecting away from the central rib to avoid the presence of any side hook receiver between the at least one side arm and the first elongate base strip.

In some arrangements, the second continuous profile member includes a side arm arrangement and alternating first and second sections along the zipper direction, wherein: in each one of the plurality of first sections, the side arm arrangement comprises at least one side arm projecting away from the central rib and defining a side hook receiver on the central rib between each side arm and the first elongate base strip; and in each one of the plurality of second sections, there is an absence of a side arm projecting away from the central rib to avoid the presence of any side hook receiver between the at least one side arm and the first elongate base strip.

In some arrangements, in each one of the plurality of second sections in the first continuous profile member and the second continuous profile member, the side arm arrangement comprises at least one side arm projecting along the rib and toward the first elongate base strip to avoid the presence of any side hook receiver between the at least one side arm and the first elongate base strip.

In some arrangements, the first sections of the first profile member are adjacent to the second sections of the second profile member in a direction orthogonal to the zipper direction, and the second sections of the first profile member are adjacent to the first sections of the second profile member in the direction orthogonal to the zipper direction.

In some embodiments, each of the first continuous profile member, second continuous profile member, third continuous profile member, fourth continuous profile member and fifth continuous profile member includes a side arm arrangement and alternating first and second sections along a zipper direction, wherein: in each one of the plurality of first sections, the side arm arrangement comprises at least one side arm projecting away from the central rib and defining a side hook receiver on the central rib between each side arm and the first elongate base strip; and in each one of the plurality of second sections, the side arm arrangement comprises at least one side arm projecting along the rib and toward the first elongate base strip to avoid the presence of any side hook receiver between the at least one side arm and the first elongate base strip.

In some arrangements, the first sections of the first profile member are adjacent to the second sections of at least one of the second, third, fourth, and fifth profile members in a direction orthogonal to the zipper direction; and the second sections of the first profile member are adjacent to the first sections of at least one of the second, third, fourth, and fifth profile members in a direction orthogonal to the zipper direction.

In some implementations, the first sections of the first profile member are adjacent to the second sections of the second profile member in a direction orthogonal to the zipper direction, and the second sections of the first profile member are adjacent to the first sections of the second profile member in the direction orthogonal to the zipper direction; the first sections of the second profile member are adjacent to the second sections of the third profile member in a direction orthogonal to the zipper direction, and the second sections of the second profile member are adjacent to the first sections of the third profile member in the direction orthogonal to the zipper direction; the first sections of the third profile member are adjacent to the second sections of the fourth profile member in a direction orthogonal to the zipper direction, and the second sections of the third profile member are adjacent to the first sections of the fourth profile member in the direction orthogonal to the zipper direction; and the first sections of the fourth profile member are adjacent to the second sections of the fifth profile member in a direction orthogonal to the zipper direction, and the second sections of the fourth profile member are adjacent to the first sections of the fifth profile member in the direction orthogonal to the zipper direction.

In a further aspect, a recloseable zipper closure arrangement for use in a recloseable plastic bag is provided; the recloseable zipper closure arrangement includes a first base strip having a front side and an opposite back side; the first base strip including: a continuous first profile member on the front side of the first base strip; the first profile member comprising a clicking sensory indicator strip having a central rib with a continuous peak; and a continuous elongate second profile member on the front side of the first base strip and spaced from the first profile member; the second continuous profile member comprising a clicking sensory indicator having a central rib with a continuous peak; and a second base strip having a front side and an opposite back side and having: a continuous first profile member on the front side of the second base strip and positioned to engage at least one of the first and second profile members of the first base strip.

In some embodiments, the second base strip further includes a continuous second profile member on the front side of the second base strip and spaced from the first profile member of the second base strip, the second profile member of the second base strip positioned to engage at least one of the first and second profile members of the first base strip.

In some embodiments, the first profile member of the second base strip includes a clicking sensory indicator having a central rib with a continuous peak; and the second profile member of the second base strip includes a clicking sensory indicator having a central rib with a continuous peak.

In some embodiments, each of the first profile member and second profile member of the first base strip includes a side arm arrangement and alternating first and second sections along a zipper direction, wherein: in each one of the plurality of first sections, the side arm arrangement comprises at least one side arm projecting away from the central rib and defining a side hook receiver on the central rib between each side arm and the first base strip; and in each one of the plurality of second sections, there is an absence of a side arm projecting away from the central rib to avoid the presence of any side hook receiver between the at least one side arm and the first base strip; and each of the first profile member and second profile member of the second base strip includes a side arm arrangement and alternating first and second sections along a zipper direction, wherein: in each one of the plurality of first sections, the side arm arrangement comprises at least one side arm projecting away from the central rib and defining a side hook receiver on the central rib between each side arm and the second base strip; and in each one of the plurality of second sections, there is an absence of a side arm projecting away from the central rib to avoid the presence of any side hook receiver between the at least one side arm and the second base strip; wherein a plurality of side arms of the first and second profile members of the first base strip engage a plurality of side hook receivers of the first and second profile members of the second base strip, and a plurality of side arms of the first and second profile members of the second base strip engage a plurality of side hook receivers of the first and second profile members of the first base strip.

In example arrangements, in the first base strip, the first sections of the first profile member are adjacent to the second sections of the second profile member in a direction orthogonal to the zipper direction, and the second sections of the first profile member are adjacent to the first sections of the second profile member in the direction orthogonal to the zipper direction; and in the second base strip, the first sections of the first profile member are adjacent to the second sections of the second profile member in a direction orthogonal to the zipper direction, and the second sections of the first profile member are adjacent to the first sections of the second profile member in the direction orthogonal to the zipper direction.

In some example arrangements, there is at least a third continuous profile member on the front side of the first base strip and spaced from the second profile member; a fourth continuous profile member on the front side of the first base strip and spaced from the third profile member; and a fifth continuous profile member on the front side of the first base strip and spaced from the fourth profile member; at least one of the third, fourth, and fifth continuous profile members includes a clicking sensory indicator having a central rib with a continuous peak; and at least a third continuous profile member on the front side of the second base strip and spaced from the second profile member; a fourth continuous profile member on the front side of the second base strip and spaced from the third profile member; and a fifth continuous profile member on the front side of the second base strip and spaced from the fourth profile member; at least one of the third, fourth, and fifth continuous profile members on the second base strip includes a clicking sensory indicator having a central rib with a continuous peak; wherein the profile members on the first base strip are positioned to mateably engage the profile members on the second base strip.

In a further aspect, a thermoplastic pouch arrangement is provided including first and second panels defining a pouch arrangement having: opposite, closed sides; a closed bottom end; and an open top end; and a recloseable zipper closure arrangement as variously characterized herein positioned between the first and second panels.

In a further aspect, a zipper closure arrangement for use in a recloseable plastic bag is provided; the recloseable zipper closure arrangement includes a first base strip having a front side and an opposite back side; the first base strip including a plurality of profile members on the front side and spaced from each other, each profile member having: a central rib with a continuous peak; a side arm arrangement and alternating first and second sections along a zipper direction, wherein: in a plurality of first sections, the side arm arrangement comprises a pair of side arms projecting away from opposite sides of the central rib and defining a side hook receiver on the central rib between each side arm and the first base strip; and in a plurality of second sections, there is an absence of a side arm projecting away from the central rib to avoid the presence of any side hook receiver between the at least one side arm and the first base strip; and a second base strip having a front side and an opposite back side; the second base strip including a plurality of profile members on the front side of the second base strip and space from each other; each profile member having: a central rib with a continuous peak; a side arm arrangement and alternating first and second sections along a zipper direction, wherein: in a plurality of first sections, the side arm arrangement comprises a pair of side arms projecting away from opposite sides of the central rib and defining a side hook receiver on the central rib between each side arm and the second base strip; and in a plurality of second sections, there is an absence of a side arm projecting away from the central rib to avoid the presence of any side hook receiver between the at least one side arm and the second base strip; wherein a plurality of the first sections of the profile members of the first base strip have only one of the side arms in engagement with side hook receivers of profile members of the second base strip, and a plurality of the first sections of the profile members of the second base strip have only one of the side arms in engagement with side hook receivers of profile members of the first base strip.

In example arrangements, the plurality of profile members of the first base strip includes at least 3, and wherein at least 2 of the profile members have the respective first and second sections non-adjacent in a direction orthogonal to a zipper direction; and the plurality of profile members of the second base strip includes at least 3, and wherein at least 2 of the profile members have the respective first and second sections non-adjacent in a direction orthogonal to a zipper direction.

In one or more embodiments, in each one of the plurality of second sections in the profile members on the first base strip, the side arm arrangement comprises at least one side arm projecting along the rib and toward the first elongate base strip to avoid the presence of any side hook receiver between the at least one side arm and the first base strip; and in each one of the plurality of second sections in the profile members on the second base strip, the side arm arrangement comprises at least one side arm projecting along the rib and toward the second base strip to avoid the presence of any side hook receiver between the at least one side arm and the second base strip.

In another aspect, a method of modifying a closure strip of a recloseable zipper closure arrangement for use in a recloseable plastic bag is provided. the method includes a step of passing a continuous closure strip section comprising a plurality of spaced continuous, elongate profile members having a continuous rib and continuous peak into a plurality of grooves of a roller while distorting the profile members to create alternating first and second sections for each of the profile members; in each one of the plurality of first sections, a side arm arrangement results having opposite side arms projecting away from the central rib and defining side hook receivers on opposite sides of the central rib between each side arm and a base of the closure strip; and in each one of the plurality of second sections, a side arm arrangement results having side arms extending along the rib and toward the base of the closure strip to avoid the presence of side hook receivers between the side arms and the base; and the step of passing including: passing the closure strip section into the plurality of grooves of the roller, each groove having alternating narrow and wide sections, to generate the alternating first and second sections for each profile member.

In example methods, the step of passing includes passing the closure strip section into the plurality of grooves of the roller, wherein adjacent grooves have each groove having alternating narrow and wide sections that are staggered from each other.

In another aspect, a closure strip is provided made according to methods as characterized herein.

DETAILED DESCRIPTION

A. Bag or Pouch Features, Generally

Figure 1:
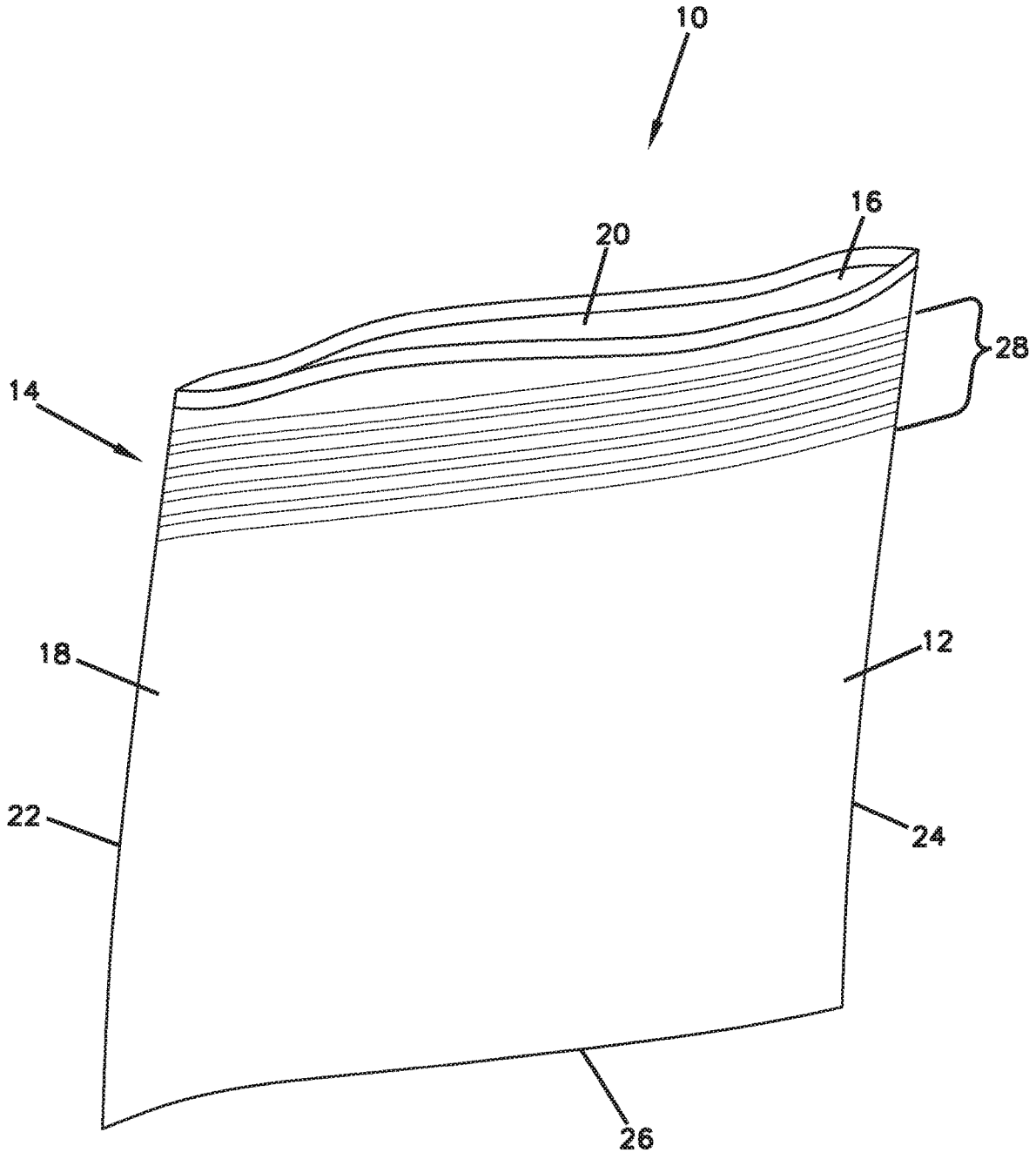
FIG. 1 is a perspective view of a recloseable bag or pouch arrangement including a press-to-close zipper closure arrangement, constructed in accordance with principles of this disclosure.

FIG. 1 illustrates a package arrangement, in accordance with the present disclosure. The package arrangement 10 generally includes a thermoplastic bag 12 provide with a recloseable (zipper) closure arrangement 14 thereon. The recloseable arrangement 14 is sometimes referenced herein as a zipper arrangement or zipper closure. The zipper closure arrangement 14 generally extends with closing capability across the bag 12 adjacent to, and spaced from, an open end or mouth 16.

The recloseable zipper closure arrangement 14 is generally positioned on the interior of the bag 12 between opposite side panels 18, 20. Finger pressure applied to the outside of the bag 12, on an opposite sides of the panels 18, 20 and along a path of longitudinal progression between opposite bag edges 22, 24 generally closes the zipper closure arrangement 14 in a zipper lock or pressure lock fashion.

In general terms, the package arrangement 10 includes bag 12 and zipper closure arrangement 14 configured from thermoplastic materials. Often, the construction is with heat seals or seams provided along the edges 22, 24. Typically, the bottom 26 of the bag 12 is either heat sealed closed or includes a continuous fold in the material of the bag 12. The bag 12, as a result, generally includes the opposite side panels 18, 20 of material. In many cases, the thermoplastic material is transparent, but could be opaque in other implementations.

The closure arrangement 14 is generally positioned with the closure features adjacent to, but spaced from, the mouth 16 of the bag 12 and used to seal the bag 12 closed, as desired.

The zipper closure arrangement 14 generally includes interlocking or mating strips of closure material positioned on each of the two panels, 18, 20 and oriented to align with one another so that pressure in a direction between the two panels 18, 20 cause engagement and closure. Pulling the two panels 18, 20 apart, adjacent the closure arrangement 14 results in unlocking or opening (unsealing) of the bag 12.

In many instances, the zipper closure arrangement 14 is provided with at least first and second closure tracks or zipper tracks, positioned adjacent to, and spaced from, one another. In the example shown in FIG. 1, a plurality of closure tracks are shown at 28. In this example, the closure tracks 28 extend generally parallel to one another and are spaced from one another but are sufficiently close so that they can generally be operated simultaneously for closing. On the opposite panel 20 are positioned an opposite set of tracks for mating with the tracks 28 on the panel 18.

There is no specific requirement that each of the tracks in the plurality of tracks 28 is identical to one another, but in many implementations, they can be identical. In other instances, they are varied from one another. In many preferred arrangements, as explained further below, adjacent tracks will have features that are staggered relative to each other. This is described further below.

In this embodiment, one or more of the tracks 28 is configured to provide a clicking sensory indicator (tactile sense and/or audible sense) of locking. The term "clicking sensory" when used in connection with defining a zipper closure arrangement is meant to refer to a closure arrangement that is configured to provide an indication of a proper engagement or sealing by a repeating clicking sensation achieved as the closure occurs. The clicking sensation or indication can be provided audibly (by sound) or by touch (tactile) sense or both. The term "clicking sensory" in and of itself is not meant to include within its scope arrangements that only indicate sealing by color change. Rather, the term "clicking" is meant to specifically reference an arrangement configured to repeatedly click (detected by touch and/or feel) as the closure or sealing occurs.

In many instances, the zipper closure arrangement 14 includes an extruded thermoplastic construction, for example, from linear low density polyethylene, that is pre-made and the secured to thermoplastic material from which the panels 18, 20 of the bag 12 are formed. Often, when the closure arrangement 14 includes the plurality of tracks 28, the tracks are extruded together during assembly.

B. Clicking Sensory (Audible and/or Tactile) Closure Indicators, Generally

Clicking sensory indicators of closures is generally provided by creating a longitudinal variation in one or more of the tracks 28, such that, as fingers are moved along the longitudinal direction of the closure arrangement 14, a regular clicking sound and/or clicking or bumpy feel is caused as locking (sealing) engagement occurs.

It is desirable that the lock or closure indication function (clicking sensory indicator) be provided by structure that are convenient to make and that do not create a false indication of closure. It is also desirable to provide a closure arrangement that can be assembled and used in an inexpensive and convenient manner. This can be accomplished with example techniques described herein.

C. Improved Closure Arrangements

In general terms, the improved zipper closure arrangement 14 includes a first base strip positioned or positionable on one of the panels 18, 20; and a second base strip that is positionable, or positioned, on the other of the panels 18, 20. The two base strips are generally positioned in the interior of the bag 12. At least one of the base strips, for example, the first base strip, will include closure tracks 28 having at least first and second continuous profile members that have a clicking sensory indicator strip. The other base strip, for example, the second base strip, will be positioned to engage at least one of the first and second profile members of the first base strip. Descriptions of example embodiments follow.

D. A Strip of Undistorted Zipper Material

The techniques described herein can, in some instances, be applied such that both halves of the zipper closure arrangement 14 (i.e., a half 38 and half 110, FIGS. 9 and 10, mounted on each panel 18, 20) can be formed by using as a starting material a single extruded zipper member, which is then used to create two strips, one for each panel 18, 20.

The term "undistorted" or "unmodified" in connection with the zipper half or closure half is meant to refer to a closure half that has not been modified substantially from the configuration it possessed when initially extruded and cooled. The term "modified" or "distorted" is meant to refer to a zipper half that has been substantially modified in configuration after initial extrusion. The modification is typically what generates a functional portion of a clicking sensory indicator arrangement, as will be apparent from the following discussions.

Figure 2:
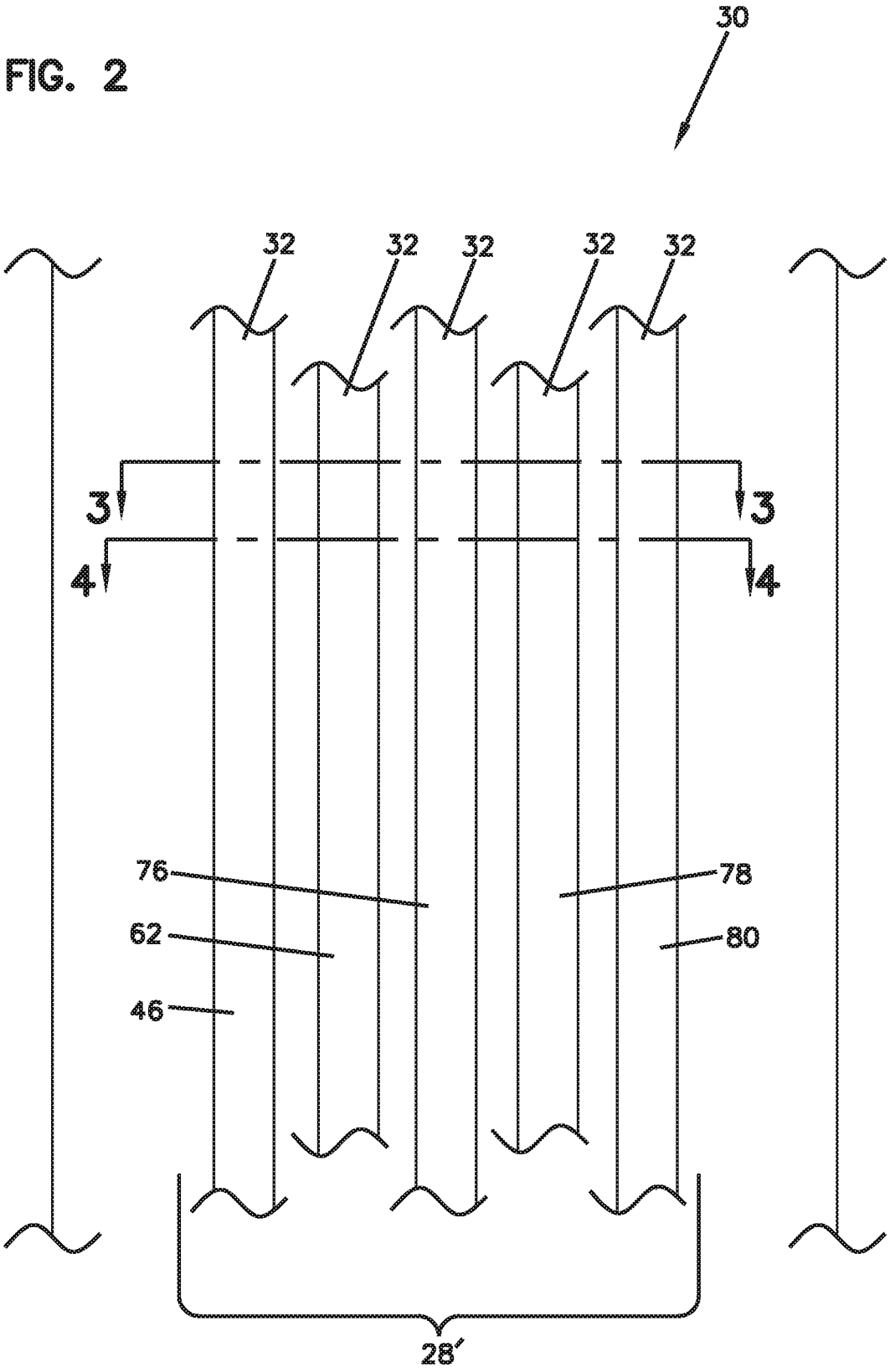
FIG. 2 is a partial plan view of an embodiment of a zipper closure arrangement prior to modification, made in accordance with principles of this disclosure.
Figure 3:
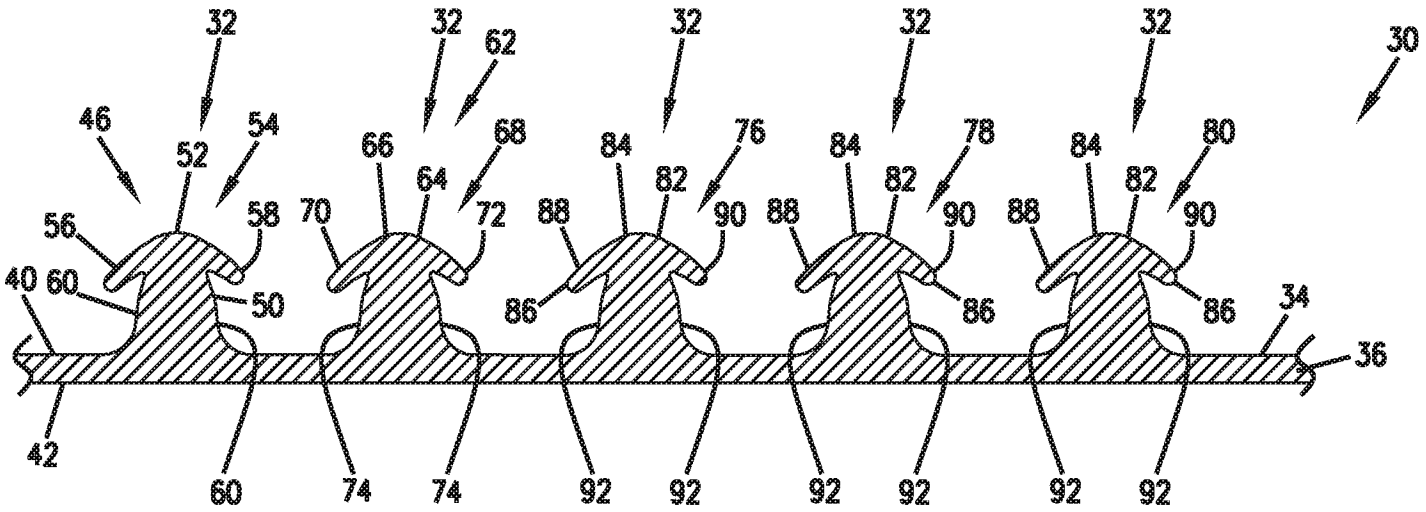
FIG. 3 is a cross-sectional view of the zipper closure arrangement of FIG. 2, prior to being modified or distorted, taken along the cross section of 3-3 of FIG. 2.
Figure 4:
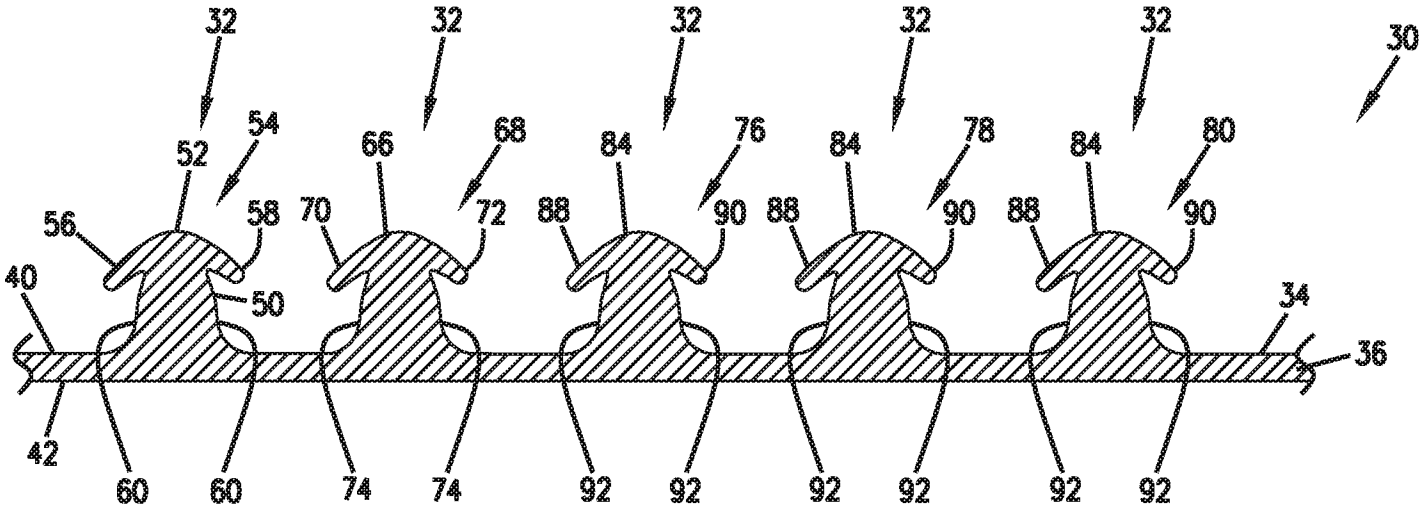
FIG. 4 is a cross-sectional view of the zipper closure arrangement of FIG. 2 and prior to being modified or distorted, the cross-section being taken along the line 4-4 of FIG. 2.

FIG. 2 is a partial plan view of a zipper closure arrangement 30 in an undistorted or unmodified form. FIGS. 3 and 4 show the cross sectional view through the unmodified zipper closure arrangement 30.

As can be seen in FIGS. 2, 3 and 4, the unmodified zipper closure arrangement 30 includes closure tracks 28' (unmodified), including plurality of continuous profile members 32 on a front side 34 of a base strip 36. Each of the profile members 32 is continuous with a continuous longitudinal extension of relatively constant cross-section, as shown.

In general terms, the base strip 36 includes a base 40 with the tracks 28' having profiled members 32 positioned thereon. The base 40 can be characterized as having a back side 42 and a front side 44. Typically, the back side 42 is featureless, and it is the front side 44 that has the profile members 32 thereon. Typically, when mounted in a pouch, the back side 42 is heat mounted on one of the panels 18, 20, along an inside surface thereof.

Still in reference to FIGS. 3 and 4, the closure arrangement 14 includes the first base strip 36 having the front side 44 and at least a first continuous profile member 46 on the front side 44 of the base strip 36. In the undistorted form, as shown in FIGS. 2-4, the first continuous profile member 46 includes a central rib 50 with a continuous peak 52. The peak 52 is remote from the base 40. In the example shown, the first continuous profile member 46 further includes an arm arrangement 54. The arm arrangement 54 includes at least one, and in the example shown, first and second opposite continuous side arms 56, 58 on opposite sides of the central rib 50. The arms 56, 58 are remote from and spaced from the base 40.

The side arms 56, 58 provide for side hook receivers or engagement recesses 60 thereunder, on opposite sides of the arms 56, 58 from the peak 52 and between the arms 56, 58 and the base 40. The side hook receivers 60 are locking receivers or regions for locking engagement with portions of mating profile member, as discussed below.

A height dimension, as measured from base 40 to the peak 52 is relatively constant, so that it does not vary substantially along the length. Although alternatives are possible, for typical arrangements, the height is within a range of 0.9-1.9 mm, usually 1.1-1.7 mm.

Advantages from a relatively constant height and lack of regular abrupt changes in the height of the profile member 46 along the peak 52 results from ensuring that the feel of the peak 52, to the person closing the bag, will not generate a regular bumpy or clicking feeling that could be improperly interpreted as a sealing or locking of the zipper closed.

Although alternatives are possible, typical width dimensions of the profile member 46 from an end of side arm 56 to an end of side arm 58, which would correspond to a maximum width of the profile member 46 is at least 0.8 mm, and usually within a range of 0.9-1.1 mm.

Still in reference to FIGS. 2-4, the first base strip 36 further includes at least a second continuous profile member 62. The second continuous profile member 62 is on the front side 44 of the base strip 36 and spaced from the first profile member 46. In the undistorted form, the second continuous profile member 62 has a central rib 64 with a continuous peak 66. The second continuous profile member further includes an arm arrangement 68 including side arms 70, 72 projecting away from the central rib 64 and defining side hook receivers 74 on the central rib 64 between each side arm 70, 72 and the base 40 of the base strip 36. In this example, the second continuous profile member is substantially identical or similar to the first profile member 46.

Many variations are possible. In some embodiments, the undistorted zipper material may include only the first and second continuous profile members 46, 62. In many embodiments, there will be more than two profile members 46, 62. In the example shown in FIGS. 2-4, there is at least a third continuous profile member 76, a fourth continuous profile member 78, and a fifth continuous profile member 80. In other arrangements, there can be more continuous profile members including six, seven, eight, nine, or ten profile members. In general, each of the continuous profile members are spaced from each other, such that the distance between adjacent side arms is at least far enough to receive a mating profile member, as described below, but close enough to allow for mateable engagement. Typically, this distance between adjacent side arms of adjacent profile members is between 0.4-0.7 mm.

For the third, fourth, and fifth continuous profile members 76, 78, 80, each can include a central rib 82 with a continuous peak 84 and a side arm arrangement 86 with side arms 88, 90 projecting away from the central rib 82 to define a side hook receiver 92 between each side arm 88, 90 and the base 40 of the base strip 36.

As can be seen by comparing FIGS. 3 and 4, the cross-section of each profile member 32 is relatively uniform along the length, when in the unmodified or undistorted form.

E. Variation to Base Strip 36 to Provide Clicking Sensory (Audible/Tactile) Indication of Closure In a section of the zipper closure arrangement 14, FIG. 1, in which a clicking sensory (tactile or audible) indicator is desired for an indication to the user of a locked or sealed closure, it is desirable to provide a variation in the feel/sound of the closing, as fingers are run across the zipper closure arrangement 14. This can be provided by causing intermittent (alternating) variations along a longitudinal extension of the strip 36 in the profile members.

It is desired that this intermittent variation is preferably provided in a manner that does not affect substantially the constancy of the height of the central rib 50 along the length. A reason for this is that if the user feels a relatively regular alternating variation in the height, as the fingers move along the zipper, the user may interpret that variation in feel as a clicking sensory indication (tactile sense) of closure or sealing, when a sealing closure is not necessarily occurring. Thus, in general, it is desired that the closure arrangement involve providing modification to the profile members along the longitudinal length in a manner that does not affect the height along that same longitudinal length.

To create the clicking sound and/or tactile feel of closure when it does properly occur, it is desired to provide the profile members with alternating variations in locking engagement along the longitudinal extension. It is preferable that the variations be regular, i.e., comprise pluralities of different sections that alternate with each other, along a longitudinal extension of the profile members.

In a typical implementation of the techniques described herein, this result can be achieved by having first sections and second sections along the continuous profile members that alternate with each other. In the first sections, side arms can engage and be received within side hook receivers. In the second sections, there is no mateable engagement between a side arm and a side hook receiver.

Although alternatives are possible, the first sections (unmodified sections) typically are configured to extend over a linear distance of at least about 2.5 mm, typically not more than 7 mm, and usually within the range of 3-6 mm. The second sections (the modified regions) are typically configured to extend over a distance of at least 2.5 mm, not more than 7 mm, and usually an amount within the range of 3-6 mm. Variations are possible. Typically, a length ratio of the unmodified sections to the modified sections, within a given profile member, is within a range of 0.75:1 to 1.5:1, and is usually within the range of 0.9:1 to 1.3:1, although many variations are possible.

The first (unmodified) sections and the second (modified) sections typically alternate with one another along the length of the extension. Thus, during closure, the user would typically feel and hear snap (clicking) closure of the mating profiles in the first (unmodified) sections; and will not feel and/or hear as strong of a snap-fit sealing engagement in the regions of the second (modified) sections. This creates the regular clicking seal and/or bumpy (clicking) feel of an indication of closure in the strips.

In many embodiments, it is convenient to make modifications to the profile members 46, 62, 76, 78, 80 after initial extrusion of the unmodified zipper closure arrangement 30. A reason for this is that it is preferred that the initial extrusion be a constant one to generate a consistent strip which is then modified for use in a system in which the audible and/or tactile indication of closure is to be provided.

Figure 6:
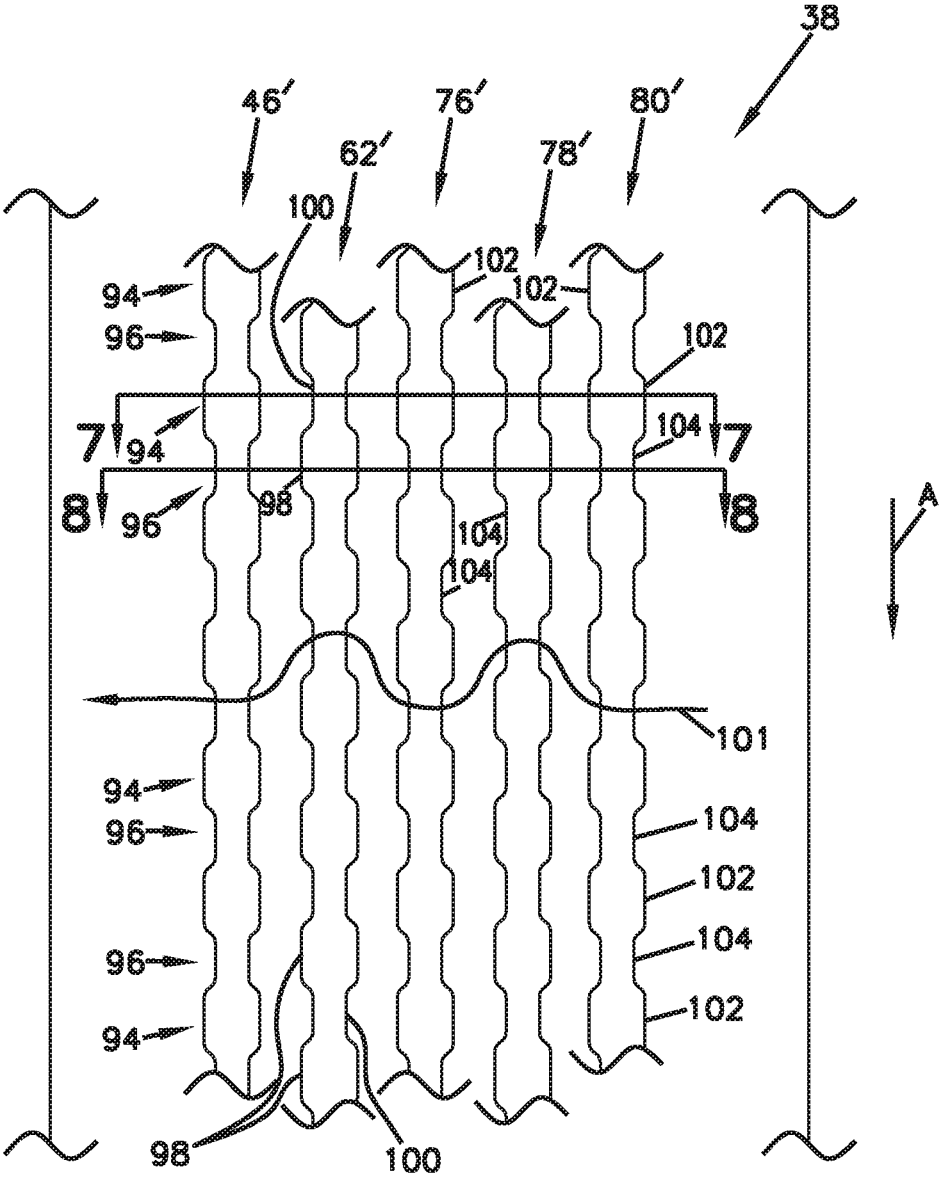
FIG. 6 is a top plan view of the zipper closure arrangement after modification or distortion using, for example, the roller arrangement of FIG. 5.
Figure 7:
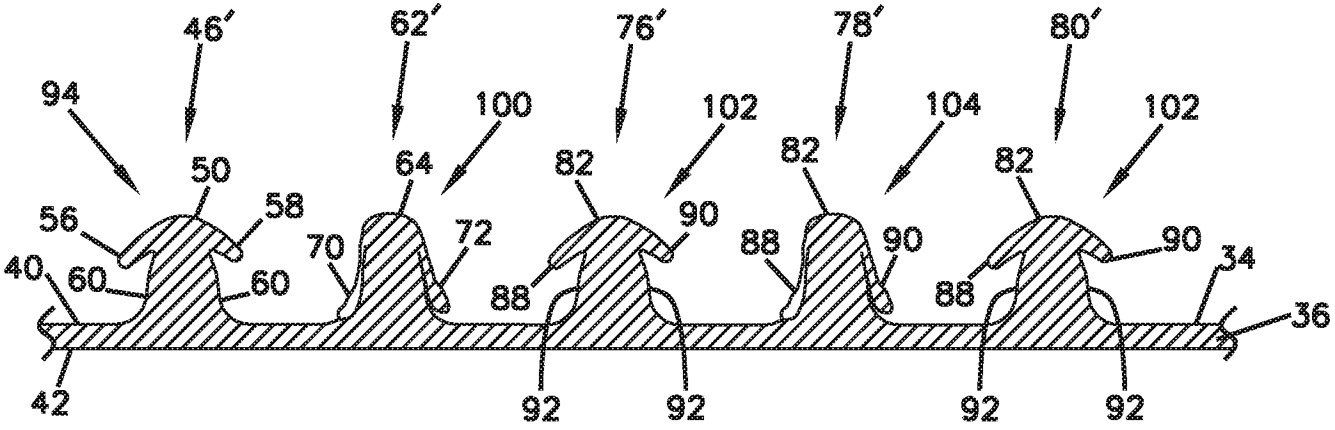
FIG. 7 is a cross-sectional view of the zipper closure arrangement of FIG. 6, the cross-section being taken along the line 7-7 of FIG. 6.
Figure 8:
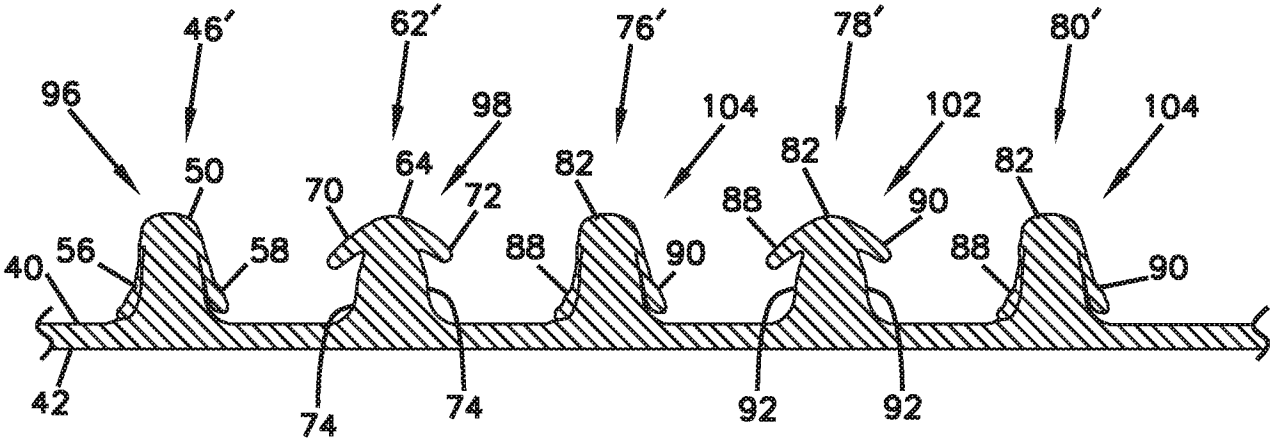
FIG. 8 is a cross-sectional view of the zipper closure arrangement of FIG. 6, the cross-section being taken along the line 8-8 of FIG. 6.

Such a modified zipper half 38 is shown in FIG. 6 and in cross-section in FIGS. 7 and 8.

Referring first to the first continuous profile member 46', in the distorted form as shown in FIGS. 7 and 8, it includes alternating first and second sections 94, 96 along the zipper direction. In each one of the first sections 94, the side arm arrangement 54 includes at least one side arm 56 projecting away from the central rib 50 and defining the side hook receiver 60 on the central rib 50 between the side arm 56 and the base 40. In many embodiments, the first section 94 will include both side arms 56, 58 projecting away from the central rib 50.

In each one of the second sections 96, there is an absence of the side arms 56, 58 projecting away from the central rib 50 to avoid the presence of any side hook receiver between the side arms 56, 58 and the base 40. This avoidance of the side arms 56, 58 being in a position projecting away from the central rib 50 can be accomplished in many different forms including, for example: (i) completely removing the arms 56, 58 at the second sections 96; or (ii) bending or otherwise modifying in a variety of fashions so that they are not projecting away from the central rib 50. In the example shown, in the second section 96, the side arm arrangement 54 includes at least one of the side arms 56, 58 projecting along the rib and toward the base 40 to avoid the presence of any side hook receiver 60. In the embodiment shown, both side arms 56, 58 project along the rib 50 and toward the base 40 to avoid the presence of side hook receivers 60.

Still in reference to FIGS. 7 and 8, the second continuous profile member 62' is shown in distorted form as including alternating first sections 98 and second sections 100. In each one of the first sections 98 (FIG. 8), the side arm arrangement 68 includes at least one of the side arms 70, 72 projecting away from the central rib 64 and defining side hook receivers 74 on the central rib 64 between each side arm 70, 72 and the base 40 of the base strip 36. In the example shown, both side arms 70, 72 project away from the central rib 64.

In the plurality of second sections 100 (FIG. 7), there is an absence of the side arms 70, 72 projecting away from the central rib 64 to avoid the presence of side hook receivers 74 between the side arms 70, 72 and the base 40. The absence of side arms in the position projecting away from the central rib 64 can be accomplished in various ways including, for example, removing the side arms 70, 72 at the sections, or otherwise distorting or modifying the side arms 70, 72. In this example, in the second sections 100, there is at least one side arm 70, 72 and typically both side arms 70, 72 that project along the rib 64 and toward the base 40 to avoid the presence of side hook receivers 74 between the side arms 70, 72 and the base 40.

Still in reference to FIGS. 6-8, there are advantages if the first sections 94, 98 of adjacent profile members 46', 62' and second sections 96, 100 of the adjacent profile members 46', 62' are "staggered." By "staggered," it is meant that when looking at the profile members in a direction orthogonal to the zipper closing and opening direction (arrow A in FIG. 6), the first sections 94 of the first profile member 46' are adjacent to the second sections 100 of the second profile member 62'; and the second sections 96 of the first profile member 46' are adjacent to the first sections 98 of the second profile member 62'. This can be appreciated by reviewing FIG. 6. By having the first and second sections of adjacent profile members staggered, a better seal is created, as gas passage, shown at line 101 through mating zippers is reduced.

In embodiments that have more than the first and second profile members 46', such as the embodiment illustrated in FIGS. 6-8, there are advantages if each of the profile members, including the third, fourth, and fifth profile members 76', 78', 80' include alternating first and second sections 102, 104 in which in each of the first sections 102, the side arm arrangements 86 include at least one side arm 88, 90, and preferably both side arms 88, 90, projecting away from the central rib 82 and defining side hook receivers 92 on the central rib 82 between each side arm 88, 90 and the base 40 of the base strip 36. In each one of the second sections 104, the side arm arrangement 86 can include the absence of the side arms 88, 90 projecting away from the central rib 82. In the example embodiments shown, the second sections 104 include at least one side arm 88, 90, and preferably both side arms 88, 90, projecting along the rib 82 and toward the base 40 of the base strip 36 to avoid the presence of side hook receivers 92 between the side arms 88, 90 and the base 40 of the base strip 36.

Many variations are possible. When there are at least the five continuous profiles, it is of advantage if the first sections 94 of the first profile member 46' are adjacent to the second sections 100, 104 of at least one of the second profile member 62', third profile member 76', fourth profile member 78', and fifth profile member 80' in a direction orthogonal to the zipper direction. It can also be of advantage if the second sections 96 of the first profile member 46' are adjacent to the first sections 98, 102 of at least one of the second profile member 62', third profile member 76', fourth profile member 78', and fifth profile member 80' in a direction orthogonal to the zipper direction.

In the embodiments shown in FIGS. 6-8, a staggered closure is shown. The first sections and second seconds of adjacent profile members are next to each other in a direction orthogonal to the zipper direction. For example, the first sections 94 of the first profile member 46' are adjacent to the second sections 100 of the second profile member 62', and the second sections 96 of the first profile member 94 are adjacent to the first sections 98 of the second profile member 62', in the direction orthogonal to the zipper direction. The first sections 98 of the second profile member 62' are adjacent to the second sections 104 of the third profile member 76', and the second sections 100 of the second profile member 62' are adjacent to the first sections 102 of the third profile member 76', in the direction orthogonal to the zipper direction. The first sections 102 of the third profile member 76' are adjacent to the second sections 104 of the fourth profile member 78', and the second sections 104 of the third profile member 76' are adjacent to the first sections 102 of the fourth profile member 78', in the direction orthogonal to the zipper direction. The first sections 102 of the fourth profile member 78' are adjacent to the second sections 104 of the fifth profile member 80', and the second sections 104 of the fourth profile member 78' are adjacent to the first sections 102 of the fifth profile member 80', in the direction orthogonal to the zipper direction. This arrangement results in reducing the passage of gas 101 therethrough.

F. Recloseable Zipper Closure Arrangement having Clicking Sensory Indicator

The previous section described a closure strip that could be used as half 38 of the zipper closure arrangement 14. The other half, which would be mated with the zipper half 38 described in connection with FIGS. 6-8 can be constructed and arranged to mate and engage with the zipper half 38.

Figure 9:
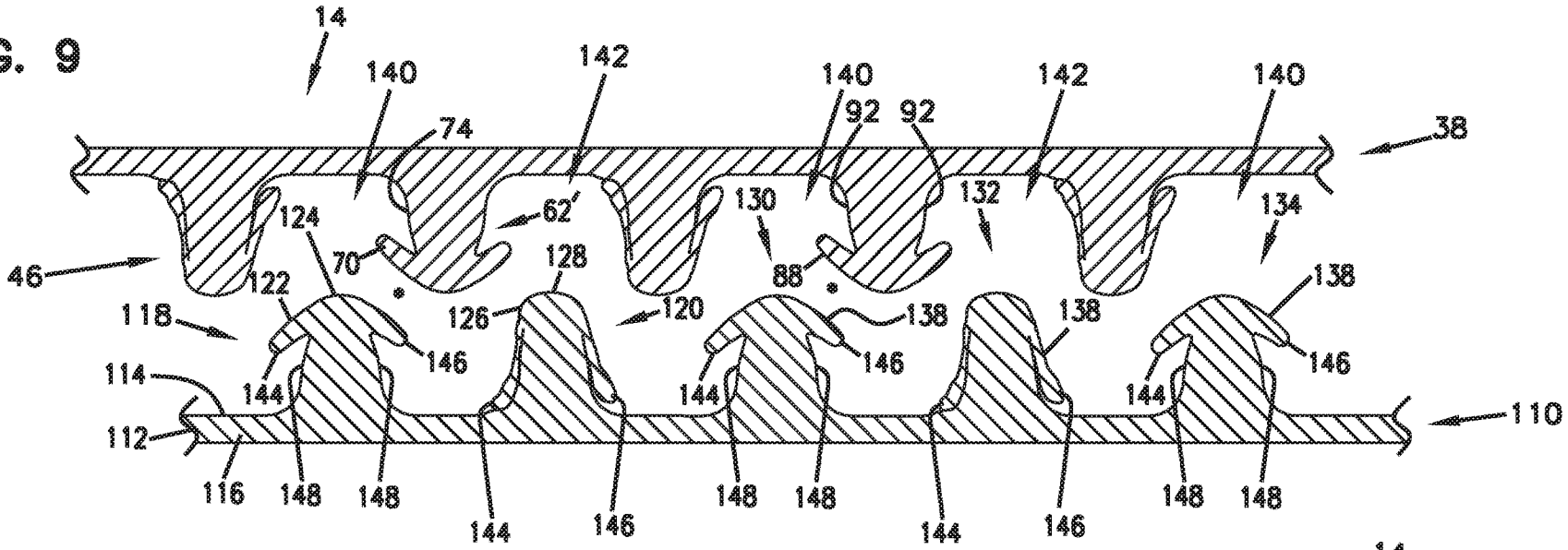
FIG. 9 is a cross-sectional view of an embodiment of a mating pair of zipper closure arrangements according to FIG. 6, illustrating the zipper closure arrangement just prior to engagement.
Figure 10:
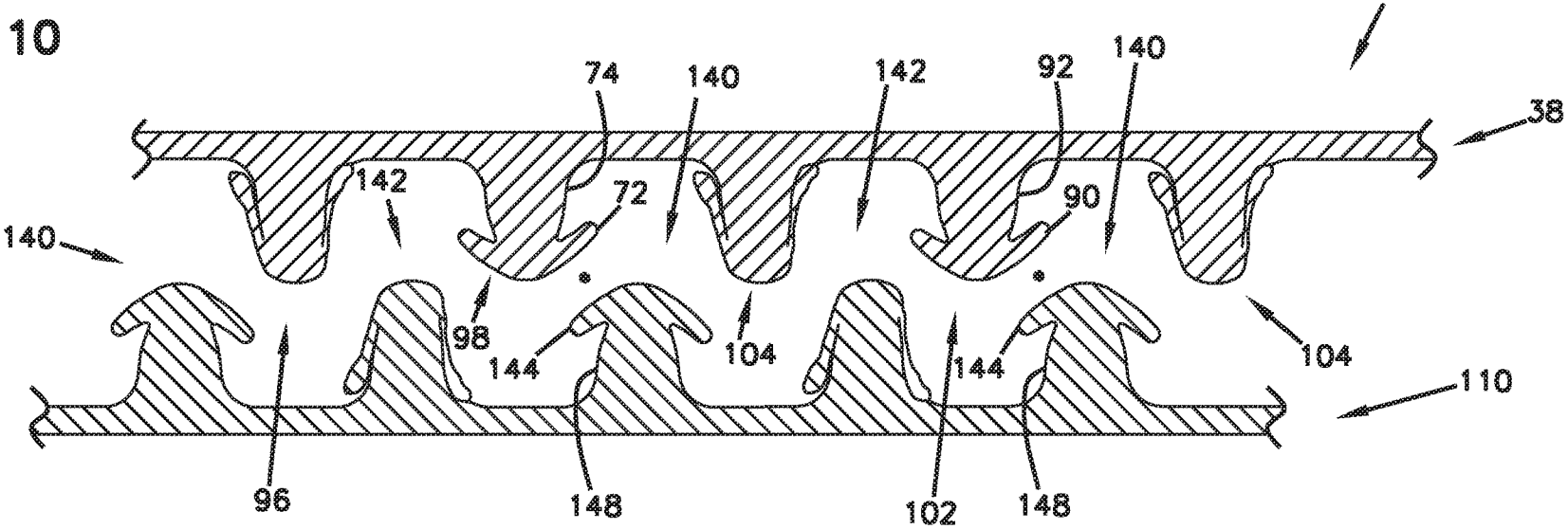
FIG. 10 is another cross-sectional view, similar to FIG. 9, and also showing a pair of the zipper closure arrangements just prior to engagement.

In FIGS. 9 and 10, a cross-section is shown along the zipper closure arrangement 14 of FIG. 1 just prior to engagement of mating zipper halves 38 and 110. The zipper half 110 includes a second base strip 112 having a front side 114 and an opposite back side 116. The second base strip 112 includes a continuous first profile member 118 on the front side 114 and positioned to engage at least one of the first profile member 46' and second profile member 62' of the first zipper half 38 of the first base strip 36.

The second base strip 112 further includes a continuous second profile member 120 on the front side 114 of the second base strip 112 and spaced from the first profile member 118 of the second base strip 112. The second profile member 120 of the second base strip 112 is positioned to engage at least one of the first and second profile members 46', 62' of the first base strip 36.

While there can be many variations, in the embodiment of FIGS. 9 and 10, the first profile member 118 of the second base strip 112 includes a clicking sensory indicator having a central rib 122 with a continuous peak 124. The second profile member 120 of the second base strip 112 preferably includes a clicking sensory indicator having a central rib 126 with a continuous peak 128.

While it is not required, in the embodiment of FIGS. 9 and 10, the zipper half 110 is constructed identically to the zipper half 38. As such, both zipper halves 38, 110 can be extruded through the same tooling. In a variation described below in connection with FIG. 11, the zipper half 110 will not include the clicking sensory indicator and will be unaltered having example structure as shown in FIGS. 2-4.

For the zipper half 110, in addition to at least the first and second profile members 118, 120, there may also be at least a third profile member 130, a fourth profile member 132, and a fifth profile member 134. There can also be six, seven, eight, nine, or ten profile members.

Although there may be variations, in the embodiment of FIGS. 9 and 10, each of the profile members 118, 120, 130, 132, 134, there are side arm arrangements 138 with alternating first and second sections 140, 142 along a zipper direction.

In each one of the first sections 140, the side arm arrangement 138 includes at least one, and preferably both side arms 144, 146 projecting away from the central rib 126 and defining a side hook receiver 148 between the side arms 144, 146 and the second base strip 112. In each one of the second sections 142, there is an absence of the side arms 144, 146 projecting away from the central rib 126 to avoid the presence of any side hook receiver 148 between the side arms 144, 146 and the second base strip 112. The second sections 144 can include either removal of the side arms 144, 146 at the sections, or as shown in the drawings, at least one or both side arms 144, 146 projecting along the rib 126 and toward the second base strip 112 to avoid the presence of any side hook receiver 148 between the side arms 144, 146 and the second base strip 112.

In FIGS. 9 and 10, a plurality of side arms 70, 88 of the first base strip 36 are shown just prior to engagement with the plurality of side hook receivers 148 of the profile members 118, 120, 130, 132, 134 of the second base strip 112. A plurality of side arms 144, 146 of the profile members 118, 120, 130, 132, 134 of the second base strip 112 engage a plurality of side hook receivers 74, 92 of the profile members 46', 62', 76', 78', 80' of the first base strip 36. FIG. 10 is the same illustration as FIG. 9, but showing the mating zipper halves 38, 110 shifted laterally; in both FIGS., there is mateable engagement, even though they are laterally shifted. Advantages result in that there is still engagement, without having to precisely align the tracks of the zipper halves 38, 110.

As with the first base strip 36, the second base strip 112 of the embodiment of FIGS. 9 and 10 is made so that the first and second sections 140, 142 are staggered between adjacent profile members. For example, the first sections 140 of the first profile member 118 are adjacent to the second sections 142 of the second profile member 120 in a direction orthogonal to the zipper direction, and the second sections 142 of the first profile member 118 are adjacent to the first sections 140 of the second profile member 120 in the direction orthogonal to the zipper direction. This staggered relationship for the second base strip 112 can be the same as described for the first base strip 36. As such, for example, the first sections 140 of the second profile member 120 are adjacent to the second sections 142 of the third profile member 130; the second sections 142 of the second profile member 120 are adjacent to the first sections 140 of the third profile member 130; the first sections 140 of the third profile member 130 are adjacent to the second sections 142 of the fourth profile member 132; the second sections 142 of the third profile member 130 are adjacent to the first sections 140 of the fourth profile member 132; the first sections 140 of the fourth profile member 132 are adjacent to the second sections 142 of the fifth profile member 134; and the second sections 142 of the fourth profile member 132 are adjacent to the first sections 140 of the fifth profile member 134 in the direction orthogonal to the zipper direction. Variations are possible.

As can be appreciated from a review of FIGS. 9 and 10, when the first base strip 36 and the second base strip 112 are placed in mateable engagement together (shown at * in FIGS. 9 and 10), a plurality of the first sections 94, 98, 102 of the profile members of the first base strip 36 have only one of the side arms 56, 58, 70, 72, 88, 90 in engagement with side hook receivers 148 of the profile members of the second base strip 112. Likewise, a plurality of the first sections 140 of the profile members of the second base strip 112 have only one of the side arms 144, 146 in engagement with side hook receivers 60, 74, 92 of profile members of the first base strip 36. In example embodiments, there is typically not any single profile member in which both side arms of a single profile member will be received within receivers of the opposite zipper half. Variations are possible.

Although in the arrangements shown, all of the profile members include distorted portions of alternating first and second sections, it should be understood that not all of the profile members need have distortions for the clicking sensory indicator to result. For example, the plurality of profile members on the first base strip 36 can include at least three, while only at least two of the profile members have the respective first and second sections non-adjacent in a direction orthogonal to the zipper direction. This is also the situation with the second base strip 112 in the FIGS. 9 and 10 embodiment.

Figure 11:
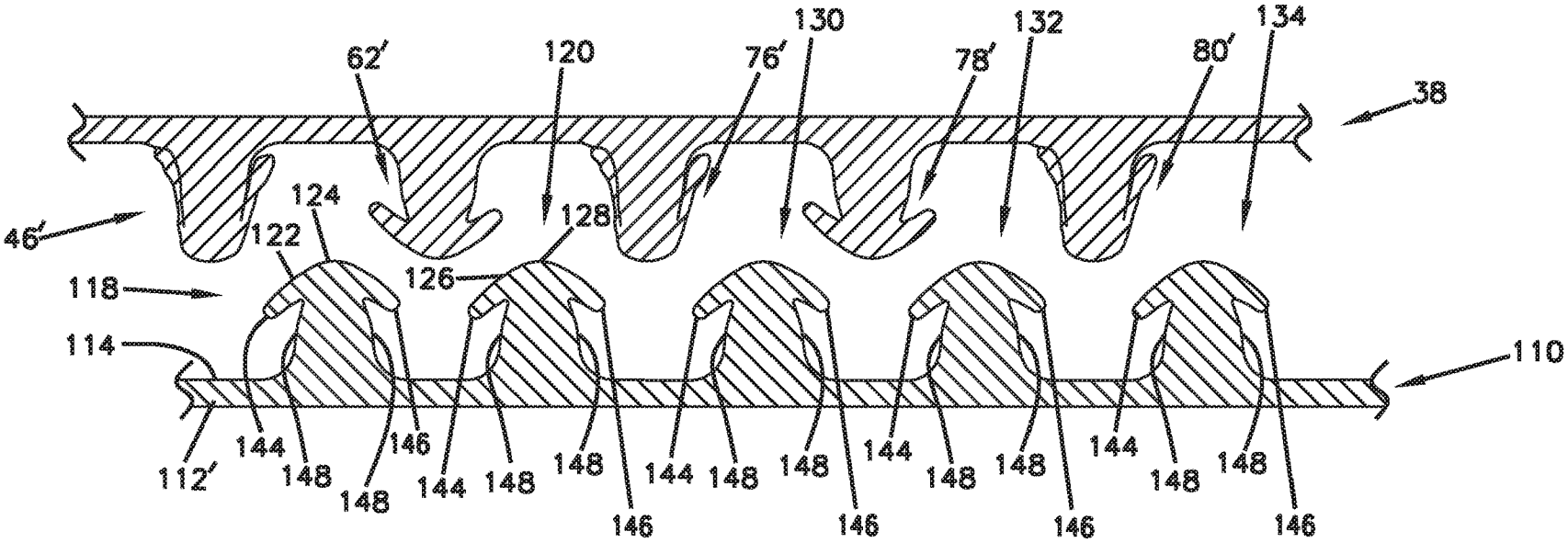
FIG. 11 is another cross-section view, similar to FIGS. 9 and 10, and showing an alternative embodiment.

In the embodiment of FIG. 11, the zipper half 110 does not include the clicking sensory indicator. Rather, the 110 is unaltered and undistorted from the structure as depicted in, for example, FIGS. 2-4. In FIG. 11, the unaltered base strip is depicted at 112'.

In FIG. 11, the second base strip 112' includes a continuous first profile member 118 on the front side 114 and positioned to engage at least one of the first profile member 46' and second profile member 62' of the first zipper half 38 of the first base strip 36. The second base strip 112' further includes a continuous second profile member 120 on the front side 114 of the second base strip 112' and spaced from the first profile member 118 of the second base strip 112'. The first profile member 118 of the second base strip 112' has a central rib 122 with a continuous peak 124. The second profile member 120 of the second base strip 112 has a central rib 126 with a continuous peak 128. In addition to at least the first and second profile members 118, 120, there may also be at least a third profile member 130, a fourth profile member 132, and a fifth profile member 134. There can also be six, seven, eight, nine, or ten profile members. Although there may be variations, in the FIG. 11 embodiment, each of the profile members 118, 120, 130, 132, 134, has two side arms 144, 146 continuously projecting away from the central rib and defining a side hook receiver 148 between the side arms 144, 146 and the second base strip 112'. For example, in the FIG. 11 embodiment, the two side arms 144, 146 are continuous and without interruption to project away from the central rib. As such, in example embodiments, they are devoid of "second sections" (as described above) having an absence of projecting side arms 144, 146.

The second base strip 112' of FIG. 11 interlocks with the first base strip 36. As compared to the embodiment of FIGS. 9 and 10, the FIG. 11 embodiment using an undistorted second base strip 112' may: (i) have a higher opening force; (ii) improve air retention in the package; and (iii) make it easier to avoid creation of air channels through the closure due to misalignment of the first base strip 36 to the second base strip 112.

G. Methods

Figure 5:
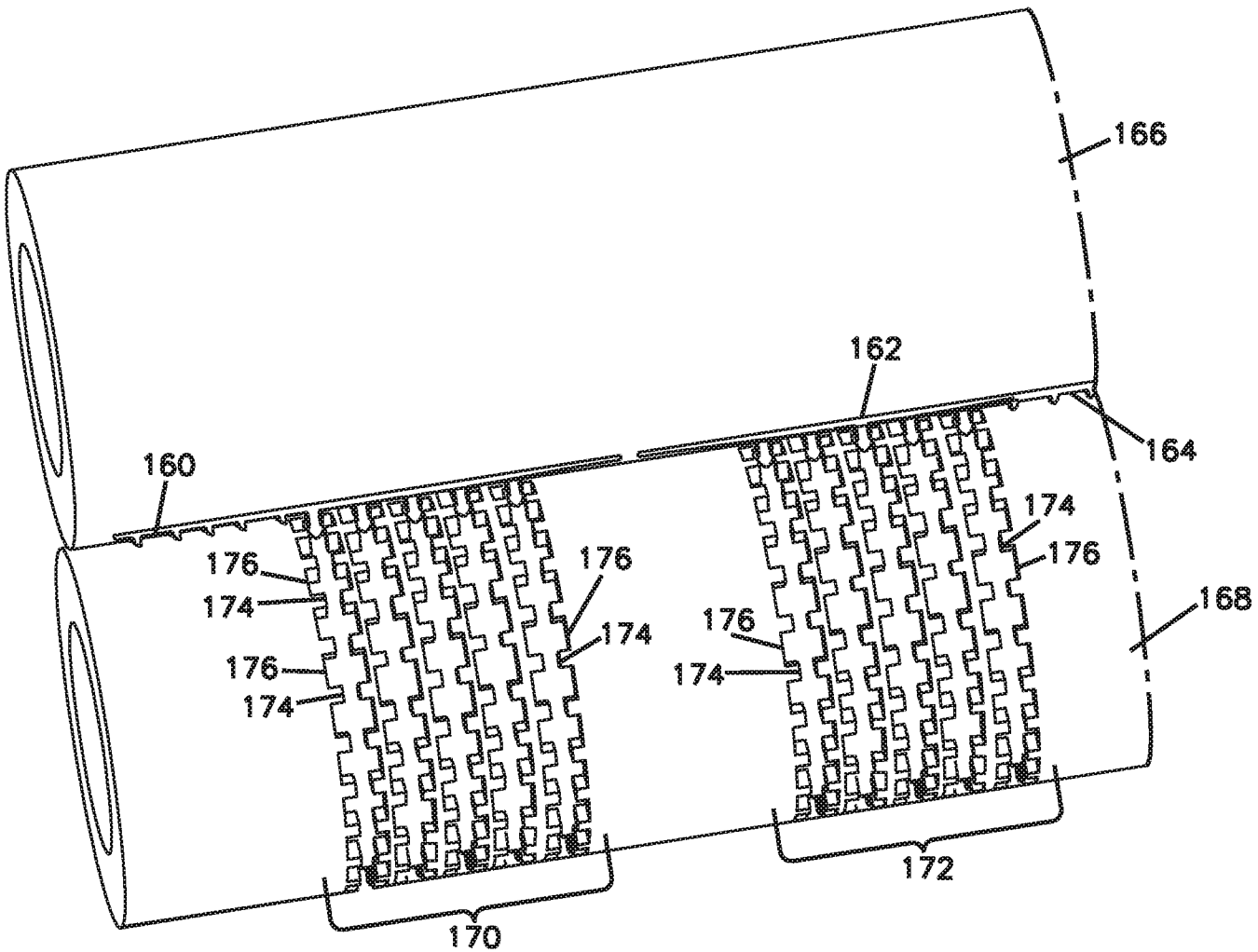
FIG. 5 is a schematic, perspective view of an embodiment of a roller arrangement used in an example method to form a distorted or modified zipper closure arrangement.

An approach to generating modified strips of FIGS. 7-10 is shown in reference to the schematic depiction of an assembly in FIG. 5. In FIG. 5, undistorted zipper halves 160, 162 are shown being pushed through a bite 164 between a pair of rollers 166, 168. Roller 168 includes first and second sets of grooves 170, 172 therein. Grooves 170 receives zipper half 160, while grooves 172 receives zipper half 162. The grooves 170, 172 modify the profiles into the alternating first sections and second sections, as described above. The modified second sections are generated by narrow groove sections 174 in the roller 168. The unmodified first sections are allowed by groove sections 176 that are sufficiently wide so as not to distort portions of the profile members. The narrow groove sections 174 are generally configured to press the side arms toward the rib, as discussed above. Variations are possible.

A typical method will include passing the continuous closure strip comprising a plurality of spaced continuous elongate profile members having a continuous rib and continuous peak into the grooves 174, 176 of roller 168 while distorting the profile members to create alternating first and second sections for each of the profile members. In each one of the first sections, a side arm arrangement results having opposite side arms projecting away from the central rib and defining side hook receivers on opposite sides of the central rib between each side arm and a base of the closure strip; and in each one of the plurality of second sections, a side arm arrangement results having side arms extending along the rib and toward the base of the closure strip to avoid the presence of side hook receivers between the side arms and the base.

The step of passing includes passing the closure strip section into the plurality of grooves 170, 172 of the roller 168, in which each groove has alternating wide sections 176 and narrow sections 174 to generate the alternating first and second sections for each profile member, as characterized previously.

As described above, it is preferred that the profile members have the first and second sections staggered relative to each other. As such, the step of passing includes passing the closure strip into the plurality of grooves 170, 172 of the roller 168, wherein the adjacent grooves have each groove having alternating narrow and wide sections 174, 176 that are staggered from each other.

The above represents example principles. Many embodiments can be made applying these principles.

What is claimed is:

1. A recloseable zipper closure arrangement useable in a recloseable plastic bag; the zipper closure arrangement comprising:

(a) a first elongate base strip having a front side and an opposite back side; and (b) a first continuous profile member on the front side of the first elongate base strip;

(i) the first continuous profile member comprising a clicking sensory indicator having a central rib with a continuous peak; and (c) a second continuous profile member on the front side of the first elongate base strip and spaced from the first profile member;

(i) the second continuous profile member comprising a clicking sensory indicator having a central rib with a continuous peak;

(d) a third continuous profile member on the front side of the first elongate base strip and spaced from the second profile member; the second profile member being between the first profile member and the third profile member;

(e) a fourth continuous profile member on the front side of the first elongate base strip and spaced from the third profile member; the third profile member being between the second profile member and the fourth profile member;

(f) a fifth continuous profile member on the front side of the first elongate base strip and spaced from the fourth profile member; the fourth profile member being between the third profile member and the fifth profile member;

(g) the first continuous profile member includes a side arm arrangement and alternating first and second sections along a zipper direction, wherein:

(i) in each one of the plurality of first sections, the side arm arrangement comprises at least one side arm projecting away from the central rib and defining a side hook receiver on the central rib between each side arm and the first elongate base strip; and (ii) in each one of the plurality of second sections, there is an absence of a side arm projecting away from the central rib to avoid the presence of any side hook receiver between the at least one side arm and the first elongate base strip;

(h) the second continuous profile member includes a side arm arrangement and alternating first and second sections along the zipper direction, wherein:

(i) in each one of the plurality of first sections, the side arm arrangement comprises at least one side arm projecting away from the central rib and defining a side hook receiver on the central rib between each side arm and the first elongate base strip;

(ii) in each one of the plurality of second sections, there is an absence of a side arm projecting away from the central rib to avoid the presence of any side hook receiver between the at least one side arm and the first elongate base strip; and (i) in each one of the plurality of second sections in the first continuous profile member and the second continuous profile member, the side arm arrangement comprises at least one side arm projecting along the rib and toward the first elongate base strip to avoid the presence of any side hook receiver between the at least one side arm and the first elongate base strip;

wherein the first sections of the first profile member are adjacent to the second sections of the second profile member in a direction orthogonal to the zipper direction, and the second sections of the first profile member are adjacent to the first sections of the second profile member in the direction orthogonal to the zipper direction.

2. The zipper closure arrangement of claim 1 wherein at least one of the third, fourth, and fifth continuous profile members includes a clicking sensory indicator having a central rib with a continuous peak.

3. The zipper closure arrangement of claim 1 wherein each of the third, fourth, and fifth continuous profile members includes a clicking sensory indicator having a central rib with a continuous peak.

4. A recloseable zipper closure arrangement for use in a recloseable plastic bag; the recloseable zipper closure arrangement comprising:

(a) a first base strip having a front side and an opposite back side; the first base strip including:

a continuous first profile member on the front side of the first base strip;

(i) the first profile member comprising a clicking sensory indicator strip having a central rib with a continuous peak; and (b) a continuous elongate second profile member on the front side of the first base strip and spaced from the first profile member; the second continuous profile member comprising a clicking sensory indicator having a central rib with a continuous peak; and (b) a second base strip having a front side and an opposite back side and having:

(i) a continuous first profile member on the front side of the second base strip and positioned to engage at least one of the first and second profile members of the first base strip; wherein the second base strip further includes a continuous second profile member on the front side of the second base strip and spaced from the first profile member of the second base strip, the second profile member of the second base strip positioned to engage at least one of the first and second profile members of the first base strip;

(c) the first profile member of the second base strip includes a clicking sensory indicator having a central rib with a continuous peak; and (d) the second profile member of the second base strip includes a clicking sensory indicator having a central rib with a continuous peak;

(e) each of the first profile member and second profile member of the first base strip includes a side arm arrangement and alternating first and second sections along a zipper direction, wherein:

(i) in each one of the plurality of first sections, the side arm arrangement comprises at least one side arm projecting away from the central rib and defining a side hook receiver on the central rib between each side arm and the first base strip; and (ii) in each one of the plurality of second sections, there is an absence of a side arm projecting away from the central rib to avoid the presence of any side hook receiver between the at least one side arm and the first base strip; and (f) each of the first profile member and second profile member of the second base strip includes a side arm arrangement and alternating first and second sections along a zipper direction, wherein:

(i) in each one of the plurality of first sections, the side arm arrangement comprises at least one side arm projecting away from the central rib and defining a side hook receiver on the central rib between each side arm and the second base strip; and (ii) in each one of the plurality of second sections, there is an absence of a side arm projecting away from the central rib to avoid the presence of any side hook receiver between the at least one side arm and the second base strip;

wherein a plurality of side arms of the first and second profile members of the first base strip engage a plurality of side hook receivers of the first and second profile members of the second base strip, and a plurality of side arms of the first and second profile members of the second base strip engage a plurality of side hook receivers of the first and second profile members of the first base strip;

(g) in the first base strip, the first sections of the first profile member are adjacent to the second sections of the second profile member in a direction orthogonal to the zipper direction, and the second sections of the first profile member are adjacent to the first sections of the second profile member in the direction orthogonal to the zipper direction; and (h) in the second base strip, the first sections of the first profile member are adjacent to the second sections of the second profile member in a direction orthogonal to the zipper direction, and the second sections of the first profile member are adjacent to the first sections of the second profile member in the direction orthogonal to the zipper direction.

5. The zipper closure arrangement of claim 4 further comprising:

(a) at least a third continuous profile member on the front side of the first base strip and spaced from the second profile member; a fourth continuous profile member on the front side of the first base strip and spaced from the third profile member; and a fifth continuous profile member on the front side of the first base strip and spaced from the fourth profile member;

(i) at least one of the third, fourth, and fifth continuous profile members includes a clicking sensory indicator having a central rib with a continuous peak; and (b) at least a third continuous profile member on the front side of the second base strip and spaced from the second profile member; a fourth continuous profile member on the front side of the second base strip and spaced from the third profile member; and a fifth continuous profile member on the front side of the second base strip and spaced from the fourth profile member;

(i) at least one of the third, fourth, and fifth continuous profile members on the second base strip includes a clicking sensory indicator having a central rib with a continuous peak;

wherein the profile members on the first base strip are positioned to mateably engage the profile members on the second base strip.

6. The zipper closure arrangement of claim 4 wherein each of the first profile member and second profile member of the second base strip includes a central rib with a continuous peak and two continuous side arms projecting away from the central rib, without interruption, to define a side hook receiver on the central rib between each side arm and the second base strip; and wherein a plurality of side arms of the first and second profile members of the first base strip engage a plurality of side hook receivers of the first and second profile members of the second base strip, and a plurality of side arms of the first and second profile members of the second base strip engage a plurality of side hook receivers of the first and second profile members of the first base strip.

7. A thermoplastic pouch arrangement comprising:

(a) first and second panels defining a pouch arrangement having: opposite, closed sides; a closed bottom end; and an open top end; and (b) a recloseable zipper closure arrangement according to claim 4 positioned between the first and second panels.

8. A zipper closure arrangement for use in a recloseable plastic bag;

the recloseable zipper closure arrangement comprising:

(a) a first base strip having a front side and an opposite back side; the first base strip including a plurality of profile members on the front side and spaced from each other, each profile member having:

(i) a central rib with a continuous peak;

(ii) a side arm arrangement and alternating first and second sections along a zipper direction, wherein:

(A) in a plurality of first sections, the side arm arrangement comprises a pair of side arms projecting away from opposite sides of the central rib and defining a side hook receiver on the central rib between each side arm and the first base strip; and (B) in a plurality of second sections, there is an absence of a side arm projecting away from the central rib to avoid the presence of any side hook receiver between the at least one side arm and the first base strip; and (b) a second base strip having a front side and an opposite back side; the second base strip including a plurality of profile members on the front side of the second base strip and space from each other; each profile member having:

(i) a central rib with a continuous peak;

(ii) a side arm arrangement and alternating first and second sections along a zipper direction, wherein:

(A) in a plurality of first sections, the side arm arrangement comprises a pair of side arms projecting away from opposite sides of the central rib and defining a side hook receiver on the central rib between each side arm and the second base strip; and (B) in a plurality of second sections, there is an absence of a side arm projecting away from the central rib to avoid the presence of any side hook receiver between the at least one side arm and the second base strip;

wherein a plurality of the first sections of the profile members of the first base strip have only one of the side arms in engagement with side hook receivers of profile members of the second base strip, and a plurality of the first sections of the profile members of the second base strip have only one of the side arms in engagement with side hook receivers of profile members of the first base strip;

(c) the plurality of profile members of the first base strip includes at least 3, and wherein at least 2 of the profile members have the respective first and second sections non-adjacent in a direction orthogonal to a zipper direction; and (d) the plurality of profile members of the second base strip includes at least 3, wherein at least 2 of the profile members have the respective first and second sections non-adjacent in a direction orthogonal to a zipper direction;

(e) in each one of the plurality of second sections in the profile members on the first base strip, the side arm arrangement comprises at least one side arm projecting along the rib and toward the first elongate base strip to avoid the presence of any side hook receiver between the at least one side arm and the first base strip; and (f) in each one of the plurality of second sections in the profile members on the second base strip, the side arm arrangement comprises at least one side arm projecting along the rib and toward the second base strip to avoid the presence of any side hook receiver between the at least one side arm and the second base strip.

9. A recloseable zipper closure arrangement useable in a recloseable plastic bag; the zipper closure arrangement comprising:

(a) a first elongate base strip having a front side and an opposite back side; and (b) a first continuous profile member on the front side of the first elongate base strip;

(i) the first continuous profile member comprising a clicking sensory indicator having a central rib with a continuous peak; and (c) a second continuous profile member on the front side of the first elongate base strip and spaced from the first profile member;

(i) the second continuous profile member comprising a clicking sensory indicator having a central rib with a continuous peak;

(d) a third continuous profile member on the front side of the first elongate base strip and spaced from the second profile member; the second profile member being between the first profile member and the third profile member;

(e) a fourth continuous profile member on the front side of the first elongate base strip and spaced from the third profile member; the third profile member being between the second profile member and the fourth profile member;

(f) a fifth continuous profile member on the front side of the first elongate base strip and spaced from the fourth profile member; the fourth profile member being between the third profile member and the fifth profile member;

wherein:

(i) each of the third, fourth, and fifth continuous profile members includes a clicking sensory indicator having a central rib with a continuous peak;

(ii) each of the first continuous profile member, second continuous profile member, third continuous profile member, fourth continuous profile member and fifth continuous profile member includes a side arm arrangement and alternating first and second sections along a zipper direction, wherein:

(A) in each one of the plurality of first sections, the side arm arrangement comprises at least one side arm projecting away from the central rib and defining a side hook receiver on the central rib between each side arm and the first elongate base strip; and (B) in each one of the plurality of second sections, the side arm arrangement comprises at least one side arm projecting along the rib and toward the first elongate base strip to avoid the presence of any side hook receiver between the at least one side arm and the first elongate base strip.

10. The zipper closure arrangement of claim 9 wherein:

(a) the first sections of the first profile member are adjacent to the second sections of at least one of the second, third, fourth, and fifth profile members in a direction orthogonal to the zipper direction; and (b) the second sections of the first profile member are adjacent to the first sections of at least one of the second, third, fourth, and fifth profile members in a direction orthogonal to the zipper direction;

(c) the first sections of the first profile member are adjacent to the second sections of the second profile member in a direction orthogonal to the zipper direction, and the second sections of the first profile member are adjacent to the first sections of the second profile member in the direction orthogonal to the zipper direction;

(d) the first sections of the second profile member are adjacent to the second sections of the third profile member in a direction orthogonal to the zipper direction, and the second sections of the second profile member are adjacent to the first sections of the third profile member in the direction orthogonal to the zipper direction;

(e) the first sections of the third profile member are adjacent to the second sections of the fourth profile member in a direction orthogonal to the zipper direction, and the second sections of the third profile member are adjacent to the first sections of the fourth profile member in the direction orthogonal to the zipper direction; and (f) the first sections of the fourth profile member are adjacent to the second sections of the fifth profile member in a direction orthogonal to the zipper direction, and the second sections of the fourth profile member are adjacent to the first sections of the fifth profile member in the direction orthogonal to the zipper direction.

* * * * *